US006014815A

United States Patent [19]

Jäger

[11] Patent Number: 6,014,815

[45] Date of Patent: Jan. 18, 2000

[54] MACHINE FOR PRODUCING A DESIGN TRACK POSITION

[75] Inventor: Heinz Jäger, Volketswil, Switzerland

[73] Assignee: J. Muller AG, Switzerland

[21] Appl. No.: 08/854,139

[22] Filed: May 9, 1997

[30] Foreign Application Priority Data

May 9, 1996 [EP] European Pat. Off. ..... 96107340

[51] Int. Cl.[7] ..... E01B 35/04

[52] U.S. Cl. ..... 33/287; 33/651.1

[58] Field of Search ..... 33/1 Q, 281, 282, 33/283, 285, 286, 287, 338, 651, 651.1, DIG. 21

[56] References Cited

U.S. PATENT DOCUMENTS 4,301,738 11/1981 theurer ..... 33/144
4,497,255 2/1985 thuerer ..... 33/1 Q
4,691,565 9/1987 theurer ..... 33/287
5,331,745 7/1994 Jager ..... 33/287

*Primary Examiner*—Bernard Roskoski
*Attorney, Agent, or Firm*—Watson Cole Grindle Watson, P.L.L.C.

[57] ABSTRACT

At a machine for the establishing of a design—track position with a machine frame which runs on chassis and with a working unit coupled thereto, a measuring unit is in accordance with the invention directly placed on the machine frame for the working unit, resp. The measuring unit is, thereby, connected to a control device which controls the working unit in accordance with at least one parameter height position, lateral position and transverse inclination via a adjusting drive. The measuring unit includes an absolute measuring system for a registering of geodetically surveyed fixed points.

7 Claims, 2 Drawing Sheets

MACHINE FOR PRODUCING A DESIGN TRACK POSITION

BACKGROUND OF THE INVENTION

1. Field of the Invention

The present invention relates to a machine including a mobile machine frame which is arranged on chassis units, including a working unit and adjusting drives adapted to adjust the working unit relative to the machine frame for establishing a design track position, and including a measuring unit of an absolute measuring system having a laser emitter adapted to register fixed points which have been geodetically surveyed and which define the absolute track position.

2. Description of the Prior Art

A measuring platform with a laser emitter which is coupled on in front of a maintenance machine and travels on tracks is already known by the international patent application WO 93/06303. A space stabilized gyro-platform, which is also arranged on the measuring platform registers the absolute change of position of the measuring platform, serves for a correcting of the angle change values of the laser emitter. The extent of the traveled path is measured either with a separate measuring device measuring the traveled distance or by means of the gyro-platform. The actual position relative to fixed points determined from these data is compared with the design value according to the survey map and if necessary a correcting of the track is performed based on this value.

The CH 684 026 A5 describes a method of measuring relative angles between a reference direction of a measuring platform and fixed points located at a distance therefrom by means of light rays originating at the measuring platform. They are reflected back by reflecting means placed at the fixed points and are received and processed by receiving means foreseen at the measuring platform.

In a technical article with the title "Automatische Steuerung von Gleisbaumaschinen nach Vermessungsfixpunkten" (Automatic controlling of track construction machines in accordance with survey fixed points) of the periodical "Der Eisenbahningenieur", September 1990, pages 459–462 a laser control is described which operates with absolute measuring bases for the leveling and aligning by a track packing machine. This laser control consists of a rotatable laser emitter emitting a fan-shaped beam which is controlled from the track packing machine by wireless, a measuring car with a laser receiver for the leveling and aligning and a computer for the calculating of the position of the track.

Finally, a measuring vehicle with an inertial navigation system for recognizing errors of track positions is known according to an article "Lasertechnik und INS" by the periodical "Der Eisenbahningenieur"; August 1995, pages 552–558.

SUMMARY OF THE INVENTION

A general object of the present invention is to provide a machine of the kind mentioned above by means of which the position of the track, specifically in connection with a renewing of the ballastway and/or the tracks can be optimized.

A further object is to provide such a machine in which its measuring unit is arranged directly at the machine frame or working unit, respectively and is coupled to a control unit adapted to act onto the adjusting drive in order to control the working unit according to at least one parameter of the group: height position, lateral position, transverse inclination.

Such a design is specifically suitable for such machines, in which the position of the track section which seen in the direction of the advance of the work is located ahead of the machine can not be utilized as relative measuring basis, because the track is lifted by the working units of the machine and, therefore, is completely changed regarding its position, exchanged, or the ballastway is renewed. By the solution in accordance with the invention it is now for the first time possible to position also in case of such track laying machinery the new track as defined according to fixed points in a design position. Furthermore, according to a preferred embodiment, a reference system of the machine itself is advantageously no longer necessary. If the working unit is exposed to permanent vibrations, a arrangement which is remote from the machine frame is suitable, whereby then the relative movement between the machine frame and the working unit to be registered can be executed without a suffering regarding precision by a preferably contact-less distance measurement.

BRIEF DESCRIPTION OF THE DRAWINGS

The invention will be better understood and objects other than those set forth above, will become apparent when consideration is given to the following detailed description thereof. Such description makes reference to the annexed drawings, wherein.

DESCRIPTION OF THE PREFERRED EMBODIMENTS

Figure 1:
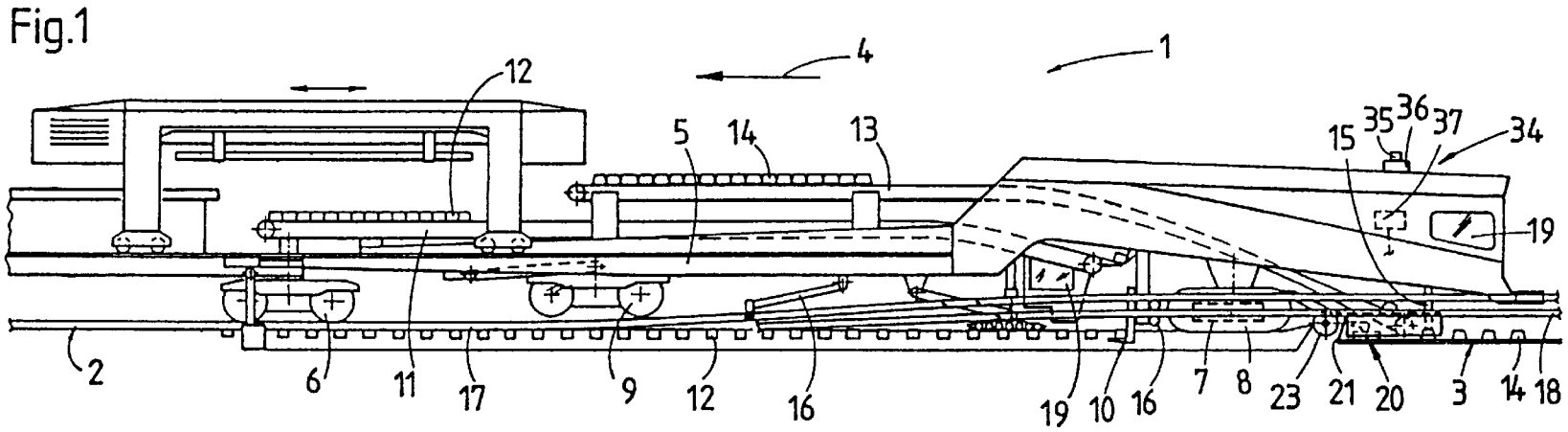
FIG. 1 is a side view of a part of a track laying machine renewing of a track way.

FIG. 1 illustrates a track laying machine 1 for a removing of a old track 2 and a laying of a new track 3, whereby a rail laying car for laying new rails 18 onto new sleepers 14, which car trails the machine relative to its traveling direction of advance of the work, is not illustrated for sake of clarity. The mobile machine which travels continuously in the direction of the arrow 4—which denotes the direction of the advance of the work—includes a machine frame 5, which when in operation is supported at its front end relative to the direction of the advance of the work via a rail chassis unit 6 on the old track 2, while the rear end of the machine frame 5 is connected to a height adjustable tracked chassis unit 8 which has its own drive. A further chassis unit 9 which is foreseen for a general traveling or running, resp. is tilted upwards into a non operative position when the machine is in operation. A sleeper taking-up device 10, to which a first transporting device for the removal of old sleepers is allocated, is located directly ahead of the tracked chassis unit 8. A second transporting device 13 for the supplying of new sleepers 14 ends at the area of a sleeper laying device 15 located behind the tracked chassis unit 8.

Figure 2:
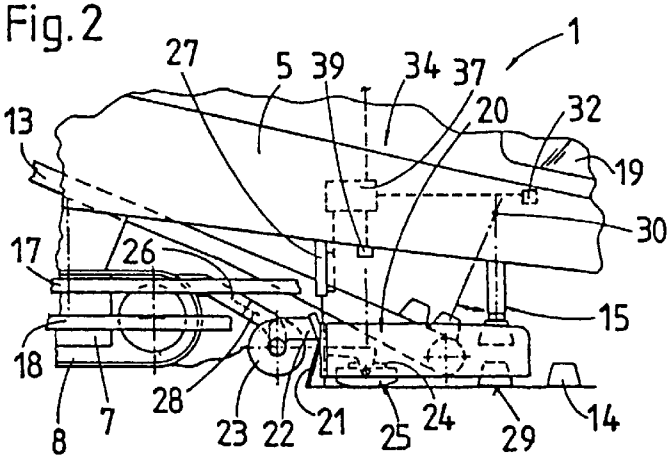

The machine 1 is equipped further with height and side adjustable rail guides 16 for the old rails 17 and new rails 18, respectively and, further, with operator cabs 19 located at the working area. In the area between the sleeper laying device 15 and the tracked chassis unit 8 a leveling device 20 is foreseen directly behind the chassis unit 8. It includes a scraper blade 21 (see FIG. 2 and 3) extending transverse to the direction of the track. At both ends of the scraper blade located at a distance transverse to the direction of the track suspensions 22 are foreseen, in which a conveyor worm 23 positioned immediately ahead of the scraper blade 21 relative to the direction of the travel of advance of the work is mounted and operative to convey accumulated ballast off towards the side. A packing device 25 equipped with vibrators 24 is foreseen in the area between the sleeper laying device 15 and the scraper blade 21.

The structural unit consisting of the conveyor worm 23, scraper blade 21 and packing device 25 is pivotally mounted via a supporting frame 26 to the machine frame 5 and is height adjustable relative to the machine frame 5 by means of adjusting drives 27. Mentioned structural unit is, furthermore, rotatable relative to the supporting frame 26 around an axis illustrated in FIG. 2, such that a desired lateral inclination of the surface 29 of the ballast packed by the packing device 29 can be produced independently from the position of the machine frame 5.

Figure 3:
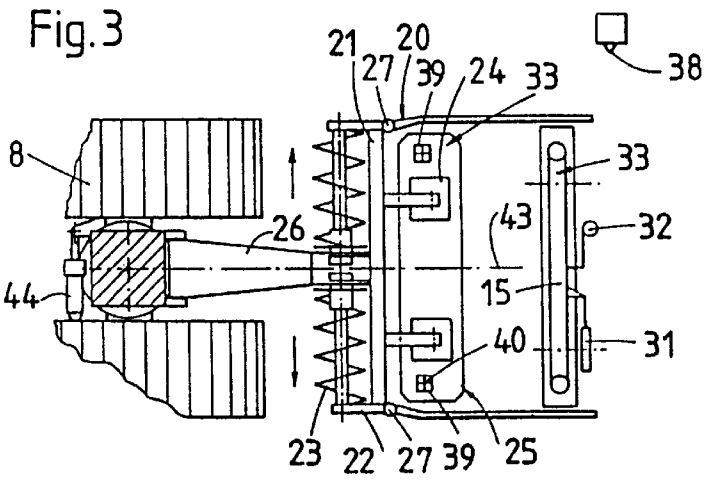
FIGS. 2 and 3 are a side view and top view of working units of the track laying machine of FIG. 1, designed on an enlarged scale.

The sleeper laying device 15 which includes at its bottom end section two suction cups located at a distance from each other in a direction transverse to the longitudinal direction of the machine for a sucking up of the new sleepers 14 is supported for a pivoting around a horizontal axis 30 extending transverse to the longitudinal direction of the machine and is, furthermore, displaceable transverse to the longitudinal direction of the machine by means of an adjusting drive 31 (FIG. 3). The lateral displacement can be measured by a electro-mechanical distance measuring device 32 which for instance is composed in this case of a rotating potentiometer mounted to the machine frame which is connected by a cable to the sleeper laying device 15.

The sleeper laying device 15 and also the packing device 25 are termed here combined by a generic term working unit 33, whereby each is allocated a respective portion of the combined duty of producing a design track position.

In order to register geodetically surveyed fix points 38 (such as schematically illustrated in FIG. 3 in connection with a overhead-line mast) which define the absolute position of the track position relative to the co-ordinates of a map such as a national map, the machine is equipped with a measuring system 34 for a determining of the absolute or design, respectively position of the track. This measuring system 34 is composed substantially of a measuring unit 36 having a laser emitter 35 and of a control device 37. Such a measuring unit is already known by the WO 93/06303 or CH 684 026 A5, respectively and described there in detail such that an entering in detail into its function is not necessary.

The control device 37 is structured to act upon the adjusting drives 27 and 31 and is coupled to the distance measuring device 32 and also to two laser emitters 39 combined with receivers located at a distance from each other in the direction transverse of the machine. They are mounted to the machine frame 5 and are foreseen for the measuring of a distance. The laser beam is reflected by target reflectors 40 which are mounted at the packing device 25.

Figure 4:
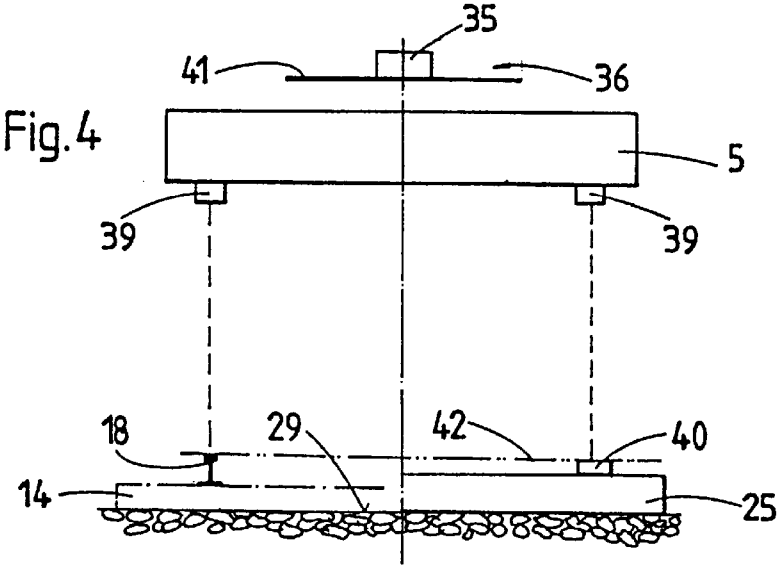
FIG. 4 is a schematic, vastly simplified illustration of a measuring unit for a controlling of the working units which is directly mounted to the machine frame.

The operation of the measuring unit 36 will now be explained more in detail with reference to the schematic illustration in accordance with FIG. 4, whereby for sake of simplicity initially only the design transverse inclination of the track will be considered. A space stabilized gyroplatform 41 of the measuring unit 36 rigidly mounted to the machine frame 5 indicates the design transverse inclination which in this simplified example extends horizontally, which means that the design transverse inclination has the value zero. By the gyro platform 42 it is now possible to measure the relative position to the machine frame 5 in all three axes, namely the position in relation to the north, as well as the horizontal and vertical positions. Because, however, the chassis units 6,8 which support the machine frame 5 on the unprecise and unknown actual position of the track or ballast, respectively, the relative position of the machine frame 5 can not be taken into consideration in this example and, therefore, reference must be made to the relative position of the packing device 25 with reference to the gyro-platform. This proceeds by a registering of the distance between the machine frame 5 and the two target reflectors 40 by means of the two laser emitters 39. In the simplified example the two target reflectors 40 are located precisely in a design track plane 42 defined by the fixed points 38 and determined by the measuring system. Conclusively, the surface 29 of the packed ballast comes to extend precisely in that height position which ensures after the laying of the new sleepers 14 and depositing of the new rails 18 a design lateral inclination and design height position of the track. In case that the relative measuring between the gyro-platform 41 and the position of the packing device 25 displays a deficiency, i.e. a fault of the lateral inclination, the control device 37 will act e.g. onto one of the two adjusting drives 27 until the two target reflectors 40 come to be located in the design track plane 42.

As already mentioned, the controlling of the design height position by a corresponding acting onto the adjusting drives occurs parallel thereto. Alternatively, a necessary lowering of the level of the surface 29 of the ballast could also proceed or supported, respectively by an increase of the frequency of the vibrators 24. As a consequence of the controlling of the packing device 25 and also of the design lateral inclination and also of the design height level the surface 29 of the ballast is located—independent from the position of the machine frame 5—in that absolute position which leads after the laying of the new sleepers 14 and the new rails 18 a desired position of the track.

The controlling with regard to the design lateral deflection of the new track 3 proceeds by a corresponding lateral displacing of the sleeper laying device 15 relative to the machine frame 5 by a acting onto the adjusting drive 31. The needed lateral displacing corresponds to the difference between the design lateral position as registered by the measuring system 34 and by the zero position of the sleeper laying device 15 (see line 43 in FIG. 3) defined by a central position of the sleeper laying device 15 in relation to the width of the machine frame 5. The corresponding lateral displacing of the sleeper laying device 15 to the desired lateral position can be registered by the distance measuring device 32. Because the two working units composed of the packing device 25 and the sleeper laying device 15 are located at a distance from each other in the longitudinal direction of the machine, the value for the design lateral position in the area of the packing device for an acting onto the adjusting drive is to be emitted when determining the design position data—encompassing the height position, the lateral position and the transverse inclination—dependent from a corresponding measuring of the distance, with a time delay.

For the operation specifically at curved sections of the track it is advantageous to carry out a lateral displacing of the packing device 25 by aid of a controlling device in dependency from the lateral displacing of the sleeper laying device 15 at an acting upon a adjusting drive 44 (FIG. 3). The steering of the tracked chassis 8 can in the same way be influenced by the controlling device.

Figure 5:
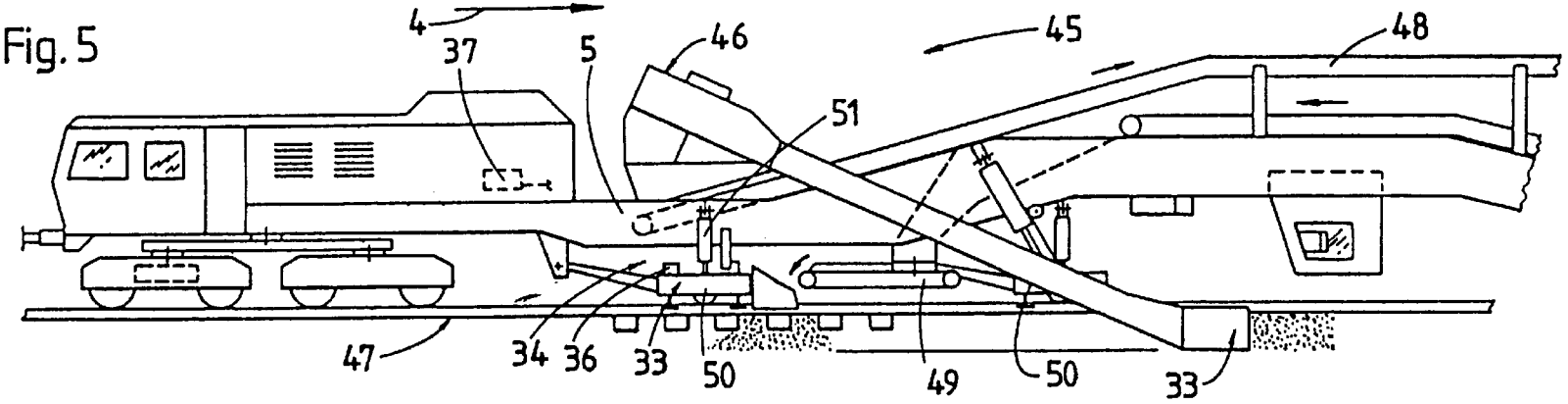
FIG. 5 illustrates a further embodiment in connection with a machine for cleaning ballast.

A track construction machine 45 illustrated in FIG. 5 only in part includes a removing unit 46 mounted onto a machine frame 5, which is led as a rotating endless chain for collecting the ballast about a track 47. The ballast which has been taken up by the removing unit 46 is fed for a cleaning thereof by the conveyor belt 48 to a not illustrated screening device. In the area of the gap where no ballast is present two track lifting devices 50 for a lifting up of the track 47 are foreseen which are arranged following each other seen in the longitudinal direction of the machine. In this embodiment the removing unit 46 as well as the track lifting devices 50 are to be termed working units 33.

A measuring unit 36 comprised of a space stabilized gyroplatform and a laser emitter and forms together with the control device 37 a measuring system 34 is mounted to the relative to the direction of work backrest driving unit 33 or the second track lifting device 50, respectively. By means of this system the design position of the track is determined such as already described in connection with the first embodiment, whereafter adjusting devices 51 perform a corresponding relative lateral and height adjustment of the working unit 33 relative to the machine frame 5 in order to therewith lay the track 47 which is connected to the track lifting device 47 onto the ballast bed in the design position.

There also exists the possibility to also enlist the control of the removing unit 46 with regard to the height position and transverse inclination, i.e. to allocate an own measuring unit 36 to the removing unit 36. Furthermore, the cleaned ballast can be leveled out and packed prior to the laying of the track 47—similar to the first embodiment.

Figure 6:
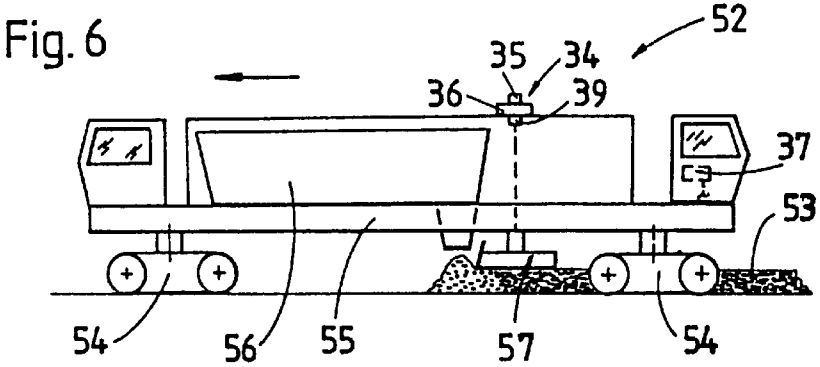
FIG. 6 is a schematic, vastly simplified side view of a machine for producing a supporting layer made of concrete or asphalt for a rigid roadway of a track.

FIG. 6 illustrates, finally, in a greatly simplified manner a machine 52 for the production of a supporting layer 53 or through respectively made of concrete or asphalt. The machine 52 is composed mainly of a machine frame 55 supported on tracked chassis 54, a container 56 for the storage of concrete or asphalt, respectively and a working unit 57. It is structured as a jarring and leveling device and is coupled to the machine frame 55 by not illustrated drives in a height adjustable manner. A measuring system 34 is mounted to the machine frame 55 above the working unit 55, which is composed of a rotating laser emitter 35, a measuring unit 36, a control unit 37 and a laser emitter 39 for a distance measuring, as well. By means of this measuring unit 36 there exists the possibility to control the working unit 57 in the same manner as the packing device in FIGS. 1 to 3 in such that a track to be laid onto the supporting layer 53 comes to lie precisely in the desired design position. Additionally, the tracked chassis 54 may also be influenced by the measuring system 34, such that the supporting layer 53 extends in the desired design position also with regard to the lateral position. At a following track laying machine for a laying of a track onto the supporting layer 53 a sleeper laying device would have to be controlled as working unit by aid of a further measuring unit 36 in such a manner that the track comes to lie in the desired design position also with regard to the lateral position.

While there are shown and described present preferred embodiments of the invention, it is distinctly to be understood that the invention is not limited thereto, bur may be otherwise variously embodied and practiced within the scope of the following claims.

I claim:

1. A railroad track machine comprising a machine frame, chassis means supporting said frame for movement relative to a rail bed, a working unit supported by said frame and being movable towards and away from the upper surface of the ballast of the rail bed and also being movable laterally of the rail bed, an adjusting drive supported by said frame and operatively connected to said working unit for adjusting the position of the working unit, first laser means supported by said frame and being adapted to detect the position of a geodetically placed marker relative to the machine frame, second laser means supported by said frame for detecting the position of the working unit relative to the machine frame, and a control device connected to each of said laser means and to said adjusting drive for controlling the operation of said adjusting drive and thereby adjusting the position of said working unit.

2. A machine as defined in claim 1 wherein said second laser means comprises at lease two reflectors supported on said working unit at laterally spaced locations thereof.

3. A machine as defined in claim 1 including a distance measuring device for measuring lateral movement of the working unit.

4. A machine as defined in claim 1 including a second working unit and a second adjusting drive operatively connected to said second working unit for adjusting the position thereof, said first-mentioned adjusting drive being operative to adjust the height of said first-mentioned working unit, said second adjusting drive being operative to adjust the lateral position of said second working unit.

5. A machine as defined in claim 4 wherein said first mentioned working unit comprises a packing unit for packing ballast, having means for vibrating said packing unit, and said second working unit comprises a sleeper laying device for laying new sleepers onto packed ballast.

6. A machine as defined in claim 1 wherein said working unit comprises a track lifting device, said adjusting drive being adapted to adjust the height and lateral position of said first working unit, and a removing unit supported by said frame for removing ballast located under a track, said removing unit being disposed ahead of said track lifting device relative to the direction of movement of the machine.

7. A machine as defined in claim 6 including a second adjusting drive operatively connected with said removing unit for adjusting the height and the transverse inclination of said removing unit.

* * * * *